US005515788A

United States Patent [19]

Theurer et al.

[11] Patent Number: 5,515,788

[45] Date of Patent: May 14, 1996

[54] TAMPING MACHINE

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 177,426

[22] Filed: Jan. 5, 1994

[30] Foreign Application Priority Data

Jan. 27, 1993 [AT] Austria ..... 132/93

[51] Int. Cl.[6] ..... E01B 27/17

[52] U.S. Cl. ..... 104/12; 104/7.2

[58] Field of Search ..... 104/2, 7.1, 7.2, 104/10, 12

[56] References Cited

U.S. PATENT DOCUMENTS

| | | | |
|---|---|---|---|
| 4,323,013 | 4/1982 | Theurer | 104/7.2 |
| 4,627,360 | 12/1986 | Theurer et al. | 104/7.2 |
| 4,825,768 | 5/1989 | Theurer et al. | 104/7.2 |
| 4,893,565 | 1/1990 | Theurer et al. | 104/7.2 |
| 4,905,604 | 3/1990 | Theurer | 104/7.2 |
| 4,928,599 | 5/1990 | Hansmann et al. | 104/12 |
| 5,013,542 | 7/1991 | Theurer | 104/12 |
| 5,127,334 | 7/1992 | Theurer | 104/12 |
| 5,133,263 | 7/1992 | Theurer | 104/12 |
| 5,329,856 | 7/1994 | Lorscheider | 104/7.2 X |

FOREIGN PATENT DOCUMENTS

| | | | |
|---|---|---|---|
| 2148361 | 5/1985 | United Kingdom | 104/12 |

*Primary Examiner*—Robert J. Oberleitner
*Assistant Examiner*—Kevin D. Rutherford
*Attorney, Agent, or Firm*—Collard & Roe

[57] ABSTRACT

A ballast tamping machine comprises an elongated machine frame, and a tool carrier frame supporting a ballast tamping head, a track lifting and lining unit and an auxiliary rail lifting device comprising a rail clamping element and drive for vertically and transversely adjusting the device for engagement of a rail of a branch track adjacent the track by the rail clamping element. A displacement drive connects the tool carrier frame to the machine frame for longitudinally displacing the tool carrier frame relative to the machine frame, and at least one undercarriage supports each frame on the track.

9 Claims, 2 Drawing Sheets

TAMPING MACHINE

BACKGROUND OF THE INVENTION

1. Field of the Invention

The present invention relates to a machine for tamping ballast under a track and movable in an operating direction, which comprises an elongated machine frame extending along the track in a longitudinal direction, a tool carrier frame supporting a ballast tamping head and a track lifting and lining unit, a displacement drive connecting the tool carrier frame to the machine frame for displacing the tool carrier frame relative to the machine frame in the longitudinal direction, and at least one undercarriage supporting each frame on the track.

2. Description of the Prior Art

Such a machine has been disclosed, for example, in U.S. Pat. No. 5,133,263. The elongated machine frame forming a bridge over the tool carrier frame moves continuously along the track during operation while the tool carrier frame moves intermittently between successive tamping stages. This machine is very efficient in tamping tangent track but cannot be used in switch sections.

Another type of continuously operating tamping machine capable of tamping two adjacent ties simultaneously is described in U.S. Pat. No. 4,928,599, but this machine, too, cannot operate in switches.

While U.S. Pat. No. 4,627,360 describes a continuously operating tamping machine with a longitudinally displaceable tool carrier frame equipped with special tamping, lifting and lining tools capable of use in switches, no such machine has been built for commercial use.

U.S. Pat. No. 4,825,768 discloses a mobile machine for leveling, lining and tamping a track switch. However, the tamping head and track lifting and lining unit are mounted on the machine frame of this machine and not on a longitudinally displaceable tool carrier frame. The machine runs on a main track and, for synchronously lifting an outer rail of a branch track in a switch section, the machine frame supports an auxiliary rail lifting device. This device is telescopingly extensible in a transverse direction for engagement with the outer branch track rail and comprises a carrier for a rail clamping element and flanged wheel associated therewith, the carrier being attached to the machine frame by a cable. In this way, the clamping element and cooperating flanged wheel can be transversely and vertically adjusted for gripping engagement with the outer branch track rail. The lifted outer branch track rail is then tamped by an auxiliary tamping unit so that the asymmetrical switch section is properly tamped along its long ties in an accurately leveled position.

SUMMARY OF THE INVENTION

It is the primary object of this invention to provide a continuously operating tamping machine of the first-described type, which can operate in track switches with a very high tamping efficiency while obtaining a very high leveling accuracy.

The above and other objects are accomplished according to the invention by supporting on the longitudinally displaceable tool carrier frame an auxiliary rail lifting device comprising a rail clamping element and drive means for vertically and transversely adjusting the device for engagement of a rail of a branch track adjacent the track by the rail clamping element.

This arrangement for the first time has made it possible to use the very efficient continuously operating tamping machines for tamping switches. With the arrangement of the auxiliary rail lifting device on the longitudinally displaceable tool carrier frame, the heavy machine frame can continue to advance continuously along the switch section while the accurate leveling of the switch in the area of its long ties proceeds. Advantageously, the highest tamping efficiency is obtained with this machine since it can continuously advance along a tangent track section towards the switch, through the switch and the tangent track section succeeding the switch. In this way, the organizationally and economically expensive use of different tampers for operation in tangent and switch track sections is eliminated. Furthermore, no so-called ramp needs to be formed in the transition zone between the switch and the succeeding tangent track. This assures not only a more accurate and stable leveling of the switch section along the area of the long ties but generally improves the tamping of tracks which include switches.

Preferably, the ballast tamping machine comprises two auxiliary rail lifting devices arranged on the tool carrier frame immediately adjacent each other in the longitudinal direction, each device being telescopingly extensible in a direction extending transversely to the longitudinal direction and including a drive for extending and retracting the device, a free end of the device carrying the rail clamping element and an end opposite the free end being pivoted to the tool carrier frame for pivoting about an axis extending in the longitudinal direction. It may further comprise a drive for adjusting the rail clamping element and a flanged wheel associated with the rail clamping element, and an operator's cab equipped with a control panel, the auxiliary rail lifting device being arranged immediately ahead of the track lifting and lining unit in the operating direction and underneath the operator's cab. Such an auxiliary rail lifting device may be controlled from its adjacent cab so that the operator is safely housed in the cab, rather than being positioned outside the machine.

The tool carrier frame is preferably supported by one of the undercarriages at a rear end, in the operating direction, and the one undercarriage is a swivel truck, further comprising a drive propelling the swivel truck. This provides an optimal support for the auxiliary rail lifting device and, in addition, the tool carrier frame is securely guided on the track so that it may be rapidly displaced relative to the machine frame as the machine continuously advances.

The ballast tamping machine may further comprise an operator's cab equipped with a control panel and arranged on the machine frame to be disposed above the swivel truck when the tool carrier frame has been longitudinally displaced into a rearmost position relative to the machine frame. This has the advantage that the operator in the cab is located on the smoothly advancing machine frame and is not subjected to the stop-and-go impacts of the intermittently displaced tool carrier frame.

The illustrated ballast tamping machine has a tamping head which comprises a twin tamping tool assembly for simultaneously tamping two adjacent ties supporting two rails of the track on the ballast, each tamping tool assembly comprising four pairs of reciprocating and vibratory tamping tools for operation along the field side and the gage side of each rail, and each tamping tool comprising two ballast tamping picks independently pivotal about an axis extending in the longitudinal direction. Each pair of tamping tools forms a tamping tool unit and the four tamping tool units are arranged adjacent each other in a direction extending transversely to the longitudinal direction and are independently displaceable in the transverse direction. Such a tamping head is very efficient for use in tangent and switch track sections, the pivotal tamping picks on four independently movable units making it possible to adapt the tamping operation to all rail configurations encountered in switches.

Finally, if respective undercarriages support respective opposite ends of the machine frame on the track, the machine may further comprise a respective trailer frame having one end pivoted to each machine frame end and an operator's cab mounted on an end of each trailer frame opposite the one trailer frame end. Such a machine will be well adapted to operation in sharp curves and may be driven in both directions along the track.

BRIEF DESCRIPTION OF THE DRAWING

The above and other objects, advantages and features of the present invention will become more apparent from the following detailed description of certain now preferred embodiments thereof, taken in conjunction with the accompanying, partly schematic drawing wherein.

DETAILED DESCRIPTION OF THE PREFERRED EMBODIMENTS

Figure 1:
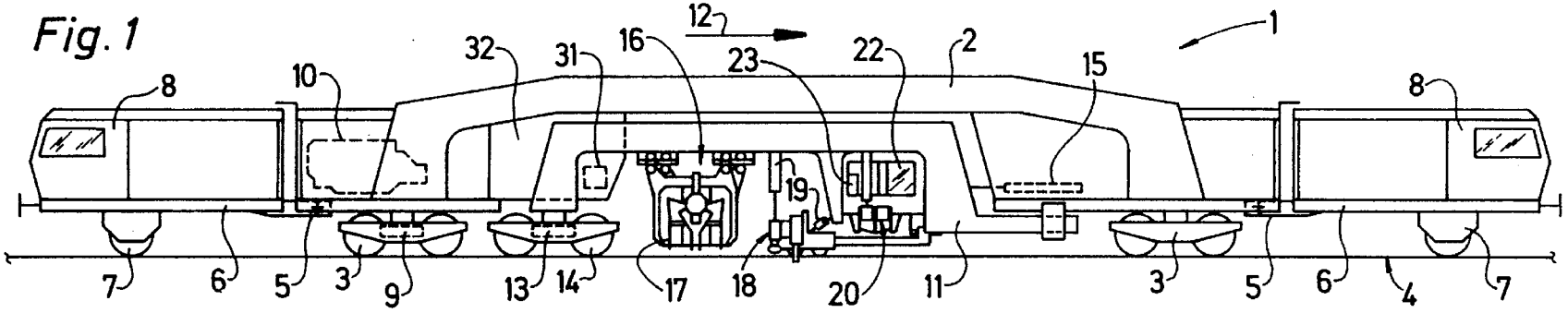
FIG. 1 is a side elevational view of one embodiment of a ballast tamping machine according to this invention.
Figure 3:
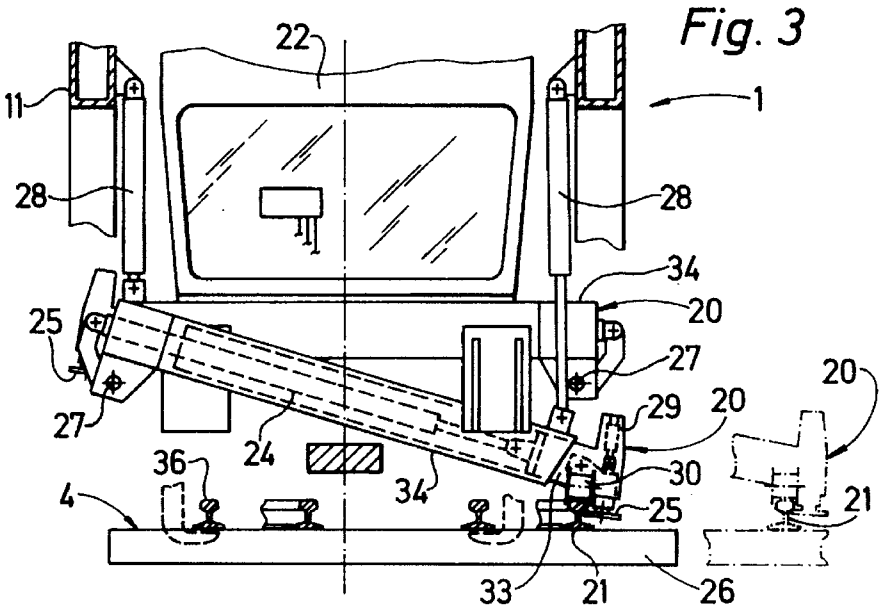
FIG. 3 is an end view taken in the direction of arrow III of FIG. 2, showing the auxiliary rail lifting device in engagement with a rail of the branch track.
Figure 2:
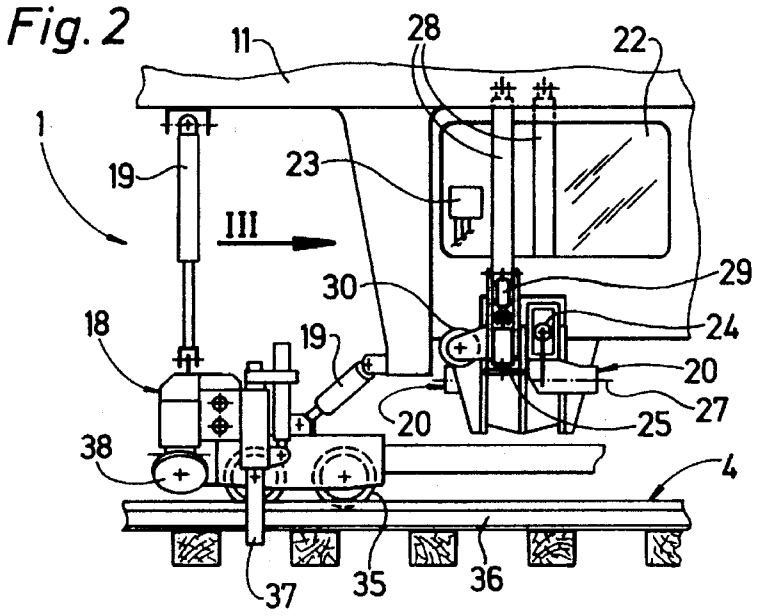
FIG. 2 is an enlarged fragmentary side view of the track lifting and lining unit and the auxiliary rail lifting device of the machine of FIG. 1.

Referring now to the drawing and first to FIGS. 1 to 3, there is shown machine 1 for tamping ballast under track 4 and movable in an operating direction indicated by arrow 12. The machine comprises bridge-like elongated machine frame 2 extending along the track in a longitudinal direction, and tool carrier frame 11 supporting ballast tamping head 16, track lifting and lining unit 18 and auxiliary rail lifting device 20 comprising rail clamping element 25 and drives 24, 28 for vertically and transversely adjusting the device for engagement of rail 21 of a branch track adjacent track 4 by the rail clamping element. Displacement drive 15 connects tool carrier frame 11 to machine frame 2 for displacing the tool carrier frame relative to the machine frame in the longitudinal direction, and undercarriages 3 and 14 support frames 2 and 11 on the track.

As shown in FIG. 1, tool carrier frame 11 is supported by one of the undercarriages 14 at a rear end, in the operating direction, and the one undercarriage is a swivel truck. Drive 13 propels the swivel truck, thus providing an additional displacement drive for the tool carrier frame. Furthermore, respective undercarriages 3, 3, which are also swivel trucks, support respective opposite ends of machine frame 2 on track 4. A respective trailer frame 6 has one end pivoted to each machine frame end by pivotal connection 5, and operator's cab 8 is mounted on an end of each trailer frame 6 opposite the one trailer frame end. Single-axle undercarriages 7, 7 support the opposite trailer frame ends on track 4. Machine frame 2 is propelled along the track by drive 9 and a power source 10 is carried on the machine frame to supply power to all the drives.

The illustrated tamping head comprises a twin tamping tool assembly for simultaneously tamping two adjacent ties supporting two rails of the track on the ballast, each rail having a field side and a gage side. Such tamping heads are known and, as shown diagrammatically in FIG. 4, each tamping tool assembly comprises four pairs of reciprocating and vibratory tamping tools for operation along the field side and the gage side of each rail, and each tamping tool comprises two ballast tamping picks 17 independently pivotal about an axis extending in the longitudinal direction. Each pair of tamping tools forms a tamping tool unit 39 and the four tamping tool units are arranged adjacent each other in a direction extending transversely to the longitudinal direction and are independently displaceable in the transverse direction.

As shown in the drawing, auxiliary rail lifting device 20 is arranged immediately ahead of track lifting and lining unit 18 in the operating direction and underneath operator's cab 22 mounted on tool carrier frame 11 and equipped with control panel 23. Drives 19 link the track lifting and lining unit to the tool carrier frame for vertically and transversely adjusting the unit for leveling and lining the track. Operator's cab 32 equipped with control panel 31 is arranged on machine frame 2 and is disposed above swivel truck 14 when tool carrier frame 11 has been longitudinally displaced into a rearmost position relative to the machine frame, as shown in FIG. 1.

As illustrated in FIGS. 2 and 3, two like auxiliary rail lifting devices 20, 20 are arranged on tool carrier frame 11 immediately adjacent each other in the longitudinal direction. In this way, a branch track on either side of track 4 may be lifted. Each device is telescopingly extensible in a direction extending transversely to the longitudinal direction and including drive 24 for extending and retracting the device. A free end of the device carries rail clamping element 25 for gripping rail 21 of a branch track in switch section 26 and an end opposite the free end is pivoted to the tool carrier frame for pivoting about axis 27 extending in the longitudinal direction. Each auxiliary rail lifting device 20 is vertically adjustable by respective drive 28 linking the opposite end of the device to tool carrier frame 11. Furthermore, drive 29 is provided for adjusting rail clamping element 25 and a flanged wheel 30 is associated with the rail clamping element. The adjustable clamping element cooperates with the double-flanged wheel running on the head of rail 21, element 25 and wheel 30 being affixed to inner tube 33 of the telescoping rail lifting device, which is telescopingly engaged in outer tube 34, to which lifting drive 28 is linked. The gripping engagement of rail 21 is shown in phantom lines in FIG. 3.

FIG. 2 shows the auxiliary rail lifting device in its raised, inoperative position. Track lifting and lining unit 18 is supported on track 4 by a pair of flanged wheels 35 running on track rails 36. It comprises a vertically and transversely adjustable lifting hook 37 and a vertically and transversely adjustable lifting roller 38 for subtending the rail head during lifting.

Figure 4:
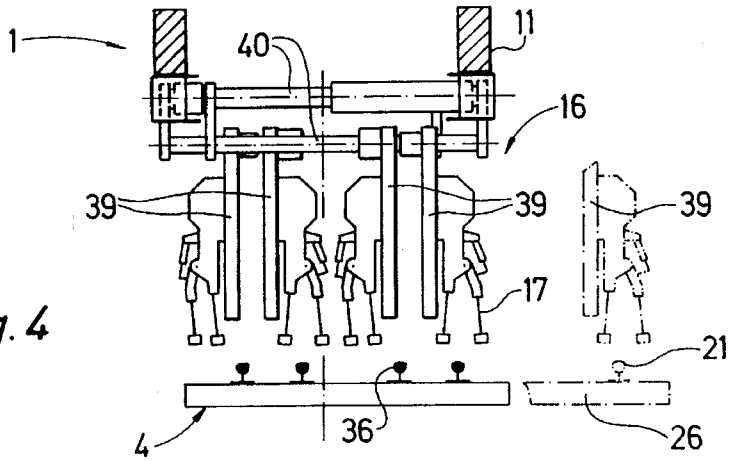
FIG. 4 is an end view showing a tamping tool assembly diagrammatically and greatly simplified.

FIG. 4 diagrammatically illustrates four tamping units 39 arranged side-by-side in a transverse direction and being movable independently of each other along transverse guide 40. In this way, the tamping units may be transversely moved to extend along the field and gage sides of the branch track rails for tamping.

Figure 5:
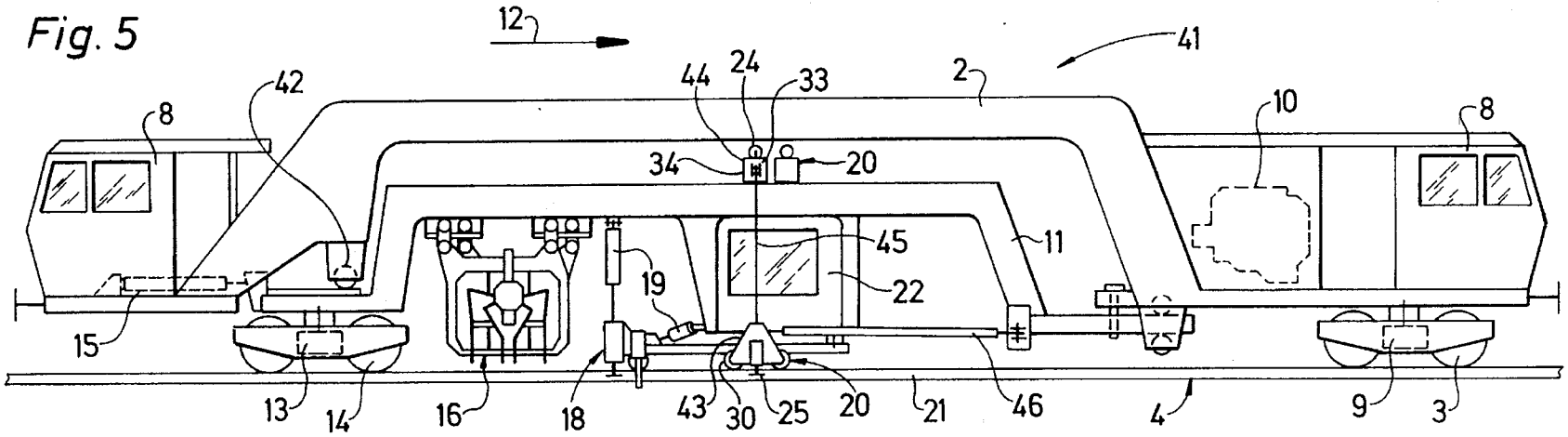
FIG. 5 is a side elevational view of another embodiment of a ballast tamping machine.

FIG. 5 illustrates another embodiment showing ballast tamping machine 41. Structures operating in a like manner are designated by the same reference numerals as in FIGS. 1 to 3 to obviate redundancy in the description. In this embodiment, only the front end of machine frame 2 is supported by an undercarriage 3 on track 4 while its rear end is supported by rollers 42 on tool carrier frame 11. Each auxiliary rail lifting device 20 is comprised of carrier 43 supporting rail clamping element 25 and associated flanged wheel 30, and carrier 44 consisting of telescoping inner and outer tubes 33, 34 mounted on tool carrier frame 11 and extensible by drive 24. The free end of inner tube 33, which is extensible and retractable in outer tube 34 by drive 24, is connected to carrier 43 by cable or rope 45. Carrier 43 frictionally engages rail 21 of the branch track and is linked by guide rod 46 to the tool carrier frame. This, too, is a continuously advancing tamper and operates substantially in a manner like that of the first-described embodiment.

The machine operates in the following manner:

The machine advances continuously along the track while tool carrier frame 11 is displaced longitudinally intermittently as the machine moves from one to the next tamping stage. When the machine operates in switch section 26, the operator is placed in cab 22 within clear view of track lifting and lining unit 18 and tamping units 39. However, the leveling, lining and tamping operation may also be controlled from cab 32. When the long ties in switch section 26 are reached, auxiliary rail lifting device 20 is put into operation by actuating drives 24 and 28 until outer rail 21 of the branch track is firmly gripped by rail clamping element 25 and cooperating flanged wheel 30. Lifting hooks 37 and/or lifting rollers 38 of track lifting and lining unit 18 are also firmly engaged with rails 36 of track 4 on which the machine runs. The switch section is then leveled by synchronous actuation of lifting drives 19 and 28 under the control of a leveling reference system (not shown) until the switch section has been lifted to the desired level. During this leveling and the subsequent tamping operation, tool carrier frame 11 stands still. Upon conclusion of this operating cycle, drives 13 and 15 are actuated to advance tool carrier frame 11 rapidly to the succeeding tamping stage where the above-described operating cycle is repeated. While the tool carrier frame is longitudinally displaced, no pressure is applied to drives 19, 24 and 28 so that the rail gripping elements only loosely engage the rails and do not interfere with the movement of the tool carrier frame. While outer rail 21 of the branch track is lifted by auxiliary rail lifting device 20, tamping unit 39 closest to the outer rail is transversely displaced along guide 40 until its tamping picks straddle the outer rail for tamping (see phantom lines in FIG. 4).

After the machine has passed switch section 26 with its long ties, auxiliary rail lifting device is put out of operation into the position shown in FIG. 2, and the succeeding track section is leveled, lined and tamped with track lifting and lining unit 18 and tamping head 16 as machine frame 2 continuously advances along track 4. When the next switch is reached, the above-described operation is repeated.

What is claimed is:

1. A machine for tamping ballast under a track and movable in an operating direction, which comprises (a) an elongated machine frame extending along the track in a longitudinal direction, (b) a tool carrier frame supporting (1) a ballast tamping head, (2) a track lifting and lining unit and (3) an auxiliary rail lifting device comprising a rail clamping element and drive means for vertically and transversely adjusting the device for engagement of a rail of a branch track adjacent the track by the rail clamping element, (c) a displacement drive connecting the tool carrier frame to the machine frame for displacing the tool carrier frame relative to the machine frame in the longitudinal direction, and (d) at least one undercarriage supporting each frame on the track.

2. The ballast tamping machine of claim 1, comprising two of said auxiliary rail lifting devices arranged on the tool carrier frame immediately adjacent each other in the longitudinal direction, each device being telescopingly extensible in a direction extending transversely to the longitudinal direction and including a drive for extending and retracting the device, a free end of the device carrying the rail clamping element and an end opposite the free end being pivoted to the tool carrier frame for pivoting about an axis extending in the longitudinal direction.

3. The ballast tamping machine of claim 2, further comprising a drive for adjusting the rail clamping element and a flanged wheel associated with the rail clamping element.

4. The ballast tamping machine of claim 1, further comprising an operator's cab equipped with a control panel, the auxiliary rail lifting device being arranged immediately ahead of the track lifting and lining unit in the operating direction and underneath the operator's cab.

5. The ballast tamping machine of claim 1, wherein the tool carrier frame is supported by one of the undercarriages at a rear end, in the operating direction, and the one undercarriage is a swivel truck, further comprising a drive propelling the swivel truck.

6. The ballast tamping machine of claim 5, further comprising an operator's cab equipped with a control panel, the operator's cab being arranged on the machine frame and disposed above the swivel truck when the tool carrier frame has been longitudinally displaced into a rearmost position relative to the machine frame.

7. The ballast tamping machine of claim 1, wherein the tamping head comprises a twin tamping tool assembly for simultaneously tamping two adjacent ties supporting two rails of the track on the ballast, each rail having a field side and a gage side, each tamping tool assembly comprising four pairs of reciprocating and vibratory tamping tools for operation along the field side and the gage side of each rail, and each tamping tool comprising two ballast tamping picks independently pivotal about an axis extending in the longitudinal direction.

8. The ballast tamping machine of claim 7, wherein each pair of tamping tools forms a tamping tool unit and the four tamping tool units are arranged adjacent each other in a direction extending transversely to the longitudinal direction and are independently displaceable in the transverse direction.

9. The ballast tamping machine of claim 1, wherein respective ones of the undercarriages support respective opposite ends of the machine frame on the track, further comprising a respective trailer frame having one end pivoted to each machine frame end and an operator's cab mounted on an end of each trailer frame opposite the one trailer frame end.

* * * * *